US007093556B1

(12) United States Patent
Werner et al.

(10) Patent No.: US 7,093,556 B1
(45) Date of Patent: Aug. 22, 2006

(54) INFLATABLE SELF-RIGHTING KAYAK SAFETY DEVICE

(76) Inventors: Robert Werner, 14240 Old Rabbit Creek Rd., Anchorage, AK (US) 99516; Sam Werner, 14240 Old Rabbit Creek Rd., Anchorage, AK (US) 99516; Margo Werner, 14240 Old Rabbit Creek Rd., Anchorage, AK (US) 99516

( * ) Notice: Subject to any disclaimer, the term of this patent is extended or adjusted under 35 U.S.C. 154(b) by 0 days.

(21) Appl. No.: 11/025,191

(22) Filed: Dec. 28, 2004

(51) Int. Cl.
*B63B 35/00* (2006.01)

(52) U.S. Cl. ..... 114/347; 114/39.23

(58) Field of Classification Search ..... 114/39.23, 114/347
See application file for complete search history.

(56) References Cited

U.S. PATENT DOCUMENTS 4,651,666 A * 3/1987 Lake ..... 114/39.23
5,191,850 A * 3/1993 Gougeon ..... 114/91
5,255,624 A * 10/1993 Legare ..... 114/68
6,390,013 B1 * 5/2002 Cornell ..... 114/347

* cited by examiner

*Primary Examiner*—Stephen Avila
(74) *Attorney, Agent, or Firm*—Michael J. Tavella

(57) ABSTRACT

A device that mounts onto the front of a kayak to assist in righting the kayak after it rolls over. It consists of a small mast that is attached to a hinged base. An inflatable bag is attached to the top of the mast along with equipment to inflate the bag. A lanyard is attached to the inflation equipment and to the top of the mast. In a rollover, the user pulls the lanyard, which causes the bag to inflate and the mast to rotate 90 degrees. This places the mast perpendicular to the kayak with the inflated bag at the far end of the mast. The inflated bag acts like an outrigger that causes the kayak to roll back upright automatically. In this way, the kayak is turned upright with minimal problems and difficulties for the user.

18 Claims, 11 Drawing Sheets

INFLATABLE SELF-RIGHTING KAYAK SAFETY DEVICE

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates safety systems for kayaks and particularly to an inflatable self-righting kayak safety device.

2. Description of the Prior Art

Kayaks have been used for water transportation for centuries. Modern kayakers use the small boats for pleasure in a variety of ways. Despite the popularity of kayaks, they have one inherent problem: they can roll over. Because of this, all kayakers typically learn the common technique to correct the rollover. This maneuver is called an "Eskimo roll", in which the user executes a reverse roll that brings the kayak upright. The only other solution to the rollover is to exit the kayak, which can cause problems in it self. Other than the Eskimo roll or exiting the kayak, there is no way presently to right a kayak that has rolled over.

The problem with the Eskimo roll is that it is a difficult maneuver to master. Moreover, in most cases, it is taught in large pools under controlled and benign conditions. It may be years before a user has a need to employ the maneuver. By then, the user has lost the skills. Of course, when the kayak rolls under real conditions, the user is often unprepared for the roll and is in colder water. These conditions often present the user with serious problems that can result in drowning.

BRIEF DESCRIPTION OF THE INVENTION

The instant invention overcomes these difficulties. It is a device that mounts onto the front of a kayak. It consists of a small mast that is attached to a hinged base. An inflatable bag is attached to the top of the mast along with equipment to inflate the bag. A lanyard is attached to the inflation equipment and to the top of the mast. In a rollover, the user pulls the lanyard, which causes the bag to inflate and the mast to rotate 90 degrees. This places the mast perpendicular to the kayak with the inflated bag at the far end of the mast. The inflated bag acts like an outrigger that causes the kayak to roll back automatically. In this way, the kayak is turned sideways with minimal problems and difficulties for the user. In that position, the user's head is above water. Then, the user can wait for help in relative safety. The system works automatically, the user only has to pull a lanyard to activate it. Thus, the need to learn complicated and difficult maneuvers that must be regularly practiced is reduced, if not eliminated. As an option, the mast can be fitted with a worm gear system that the user can crank to turn the mast down into the water. This causes the kayak to turn upright, with the mast then acting as an outrigger for the upright kayak.

DETAILED DESCRIPTION OF THE INVENTION

Figure 1:
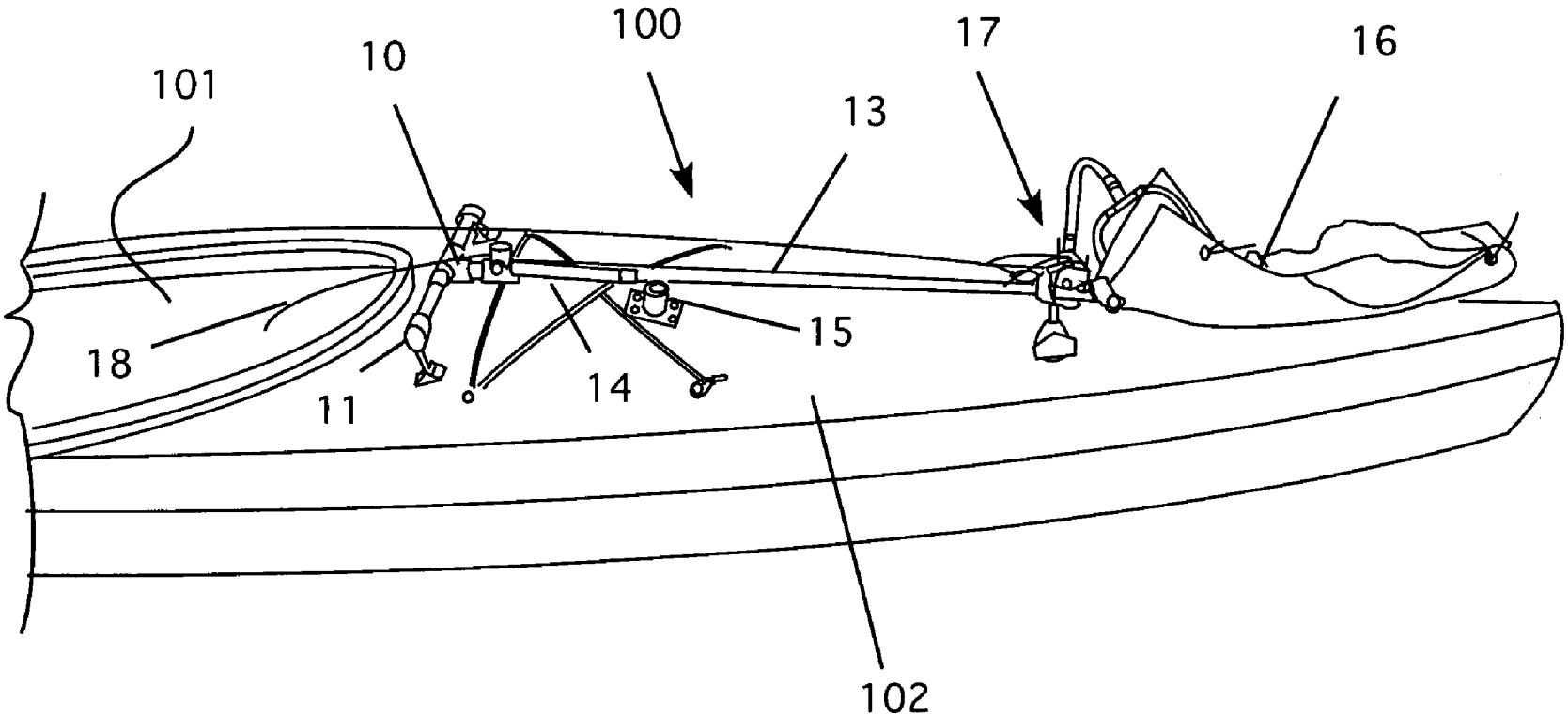
FIG. 1 is a partial view of a kayak with the device in place in its non-deployed state.

Referring now to FIG. 1, the bow portion of a kayak 100 is shown. The kayak has an entrance hole 101 for the rider to enter the kayak as shown. Near the front of the entrance is a hinge arm 10. This arm is mounted in two brackets 11, which are secured to the deck 102. The brackets allow the hinge arm to rotate freely. At the center of the hinge arm is a bracket 12, to which a mast 13 is attached. A gas lift arm 14 is attached to the mast and to a bracket 15, which is attached to the deck as shown (see also FIG. 8). This arm aids in raising the mast, as discussed below. At the top of the mast 14 is an inflatable bag 16 that is attached to an inflation system 17. Extending backward into the entrance hole is a lanyard 18. The lanyard 18 is used to activate the system. In FIG. 1, the system as shown is in its ready position.

Figure 2:
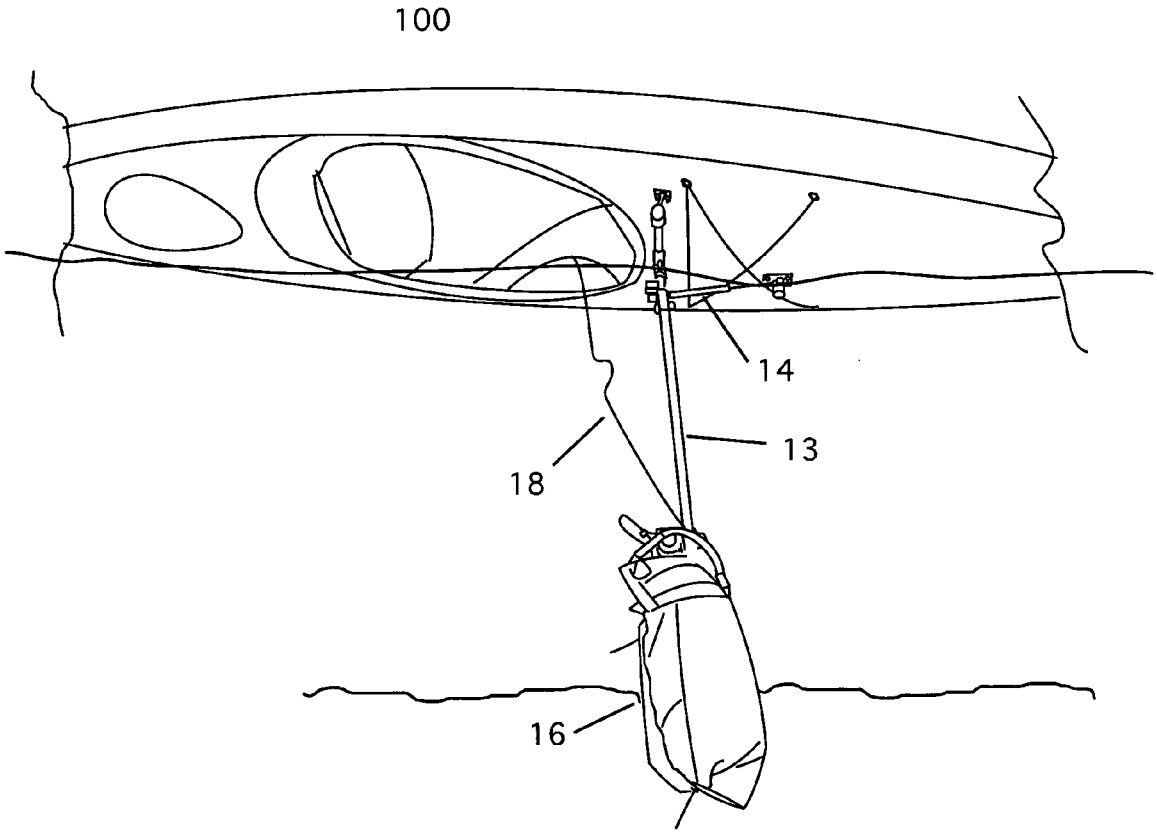
FIG. 2 is a detail side view of a rolled-over kayak with the invention deployed.

FIG. 2 shows the kayak 100 that has rolled-over and the system has just been deployed. In this figure, the kayak is upside down and the mast is pointing straight down. As shown, the inflatable bag 16 is fully inflated. The mast 13 has rotated 90 degrees and is held perpendicular to the kayak by the gas lift arm 14. As discussed above, the system is activated by pulling the lanyard 18.

Figure 3:
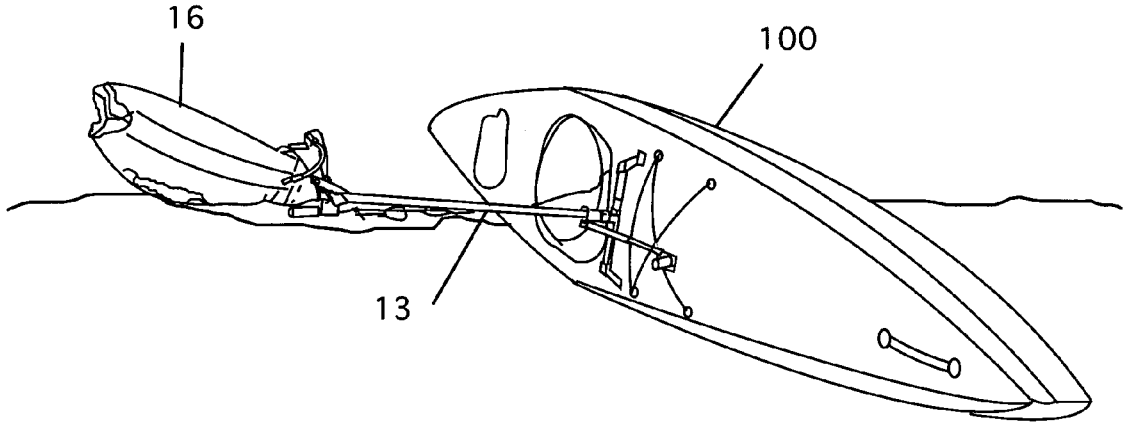
FIG. 3 is a front perspective view of a rolled-over kayak with the invention deployed.

FIG. 3 shows a front perspective view of the kayak 100 after the system has been deployed. Here, the inflatable bag 16 has rotates the kayak 100 into a sideways position. A user is now sideways with the user's head out of the water. In this position, the user can work to flip the kayak upright, or can rest while awaiting help to flip the kayak. In this position, the mast 18 and bag 16 act as an outrigger to help stabilize the kayak.

Figure 4:
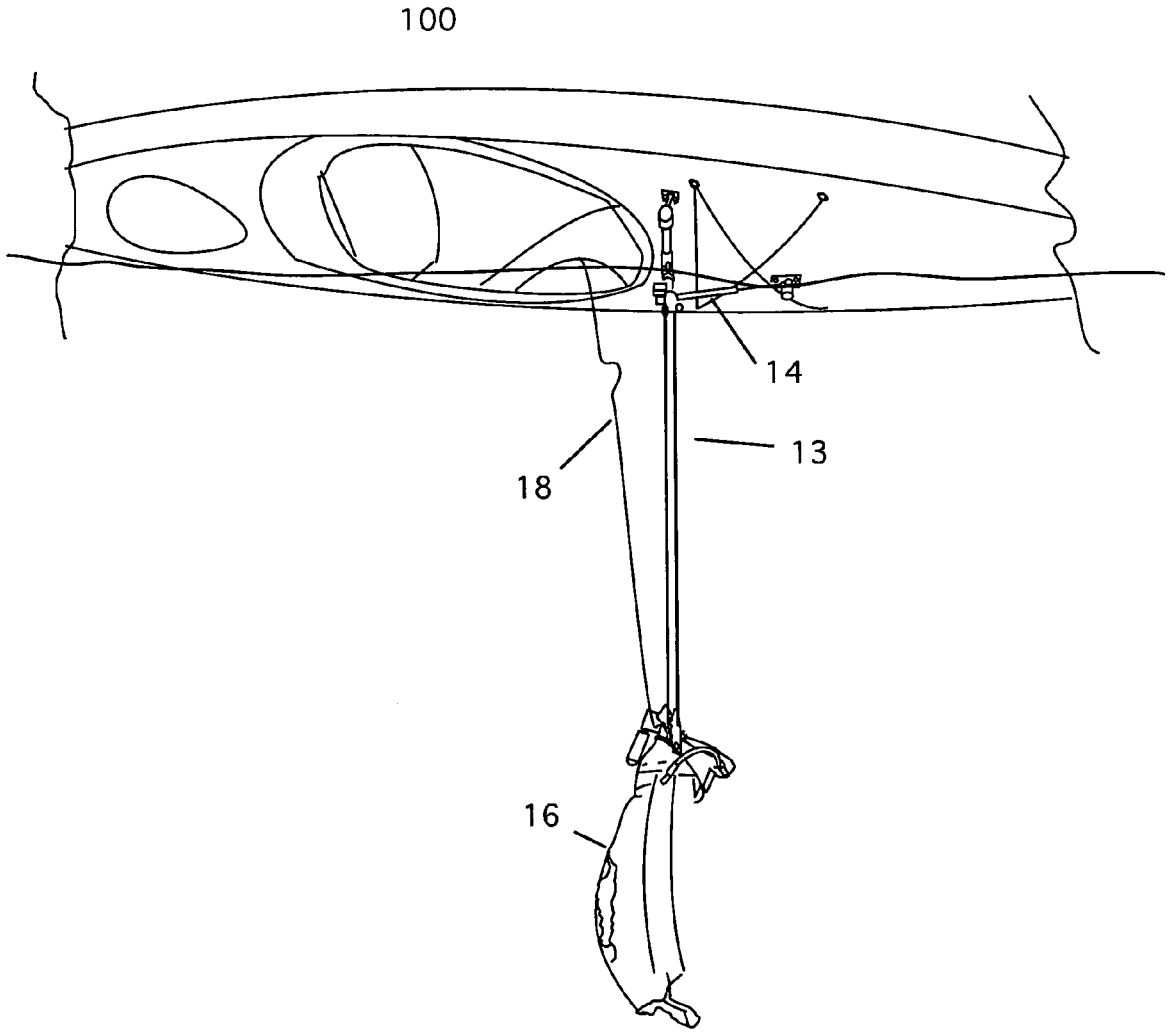
FIG. 4 is a side perspective view of the kayak showing the mast turned down with the option worm gear drive.
Figure 5:
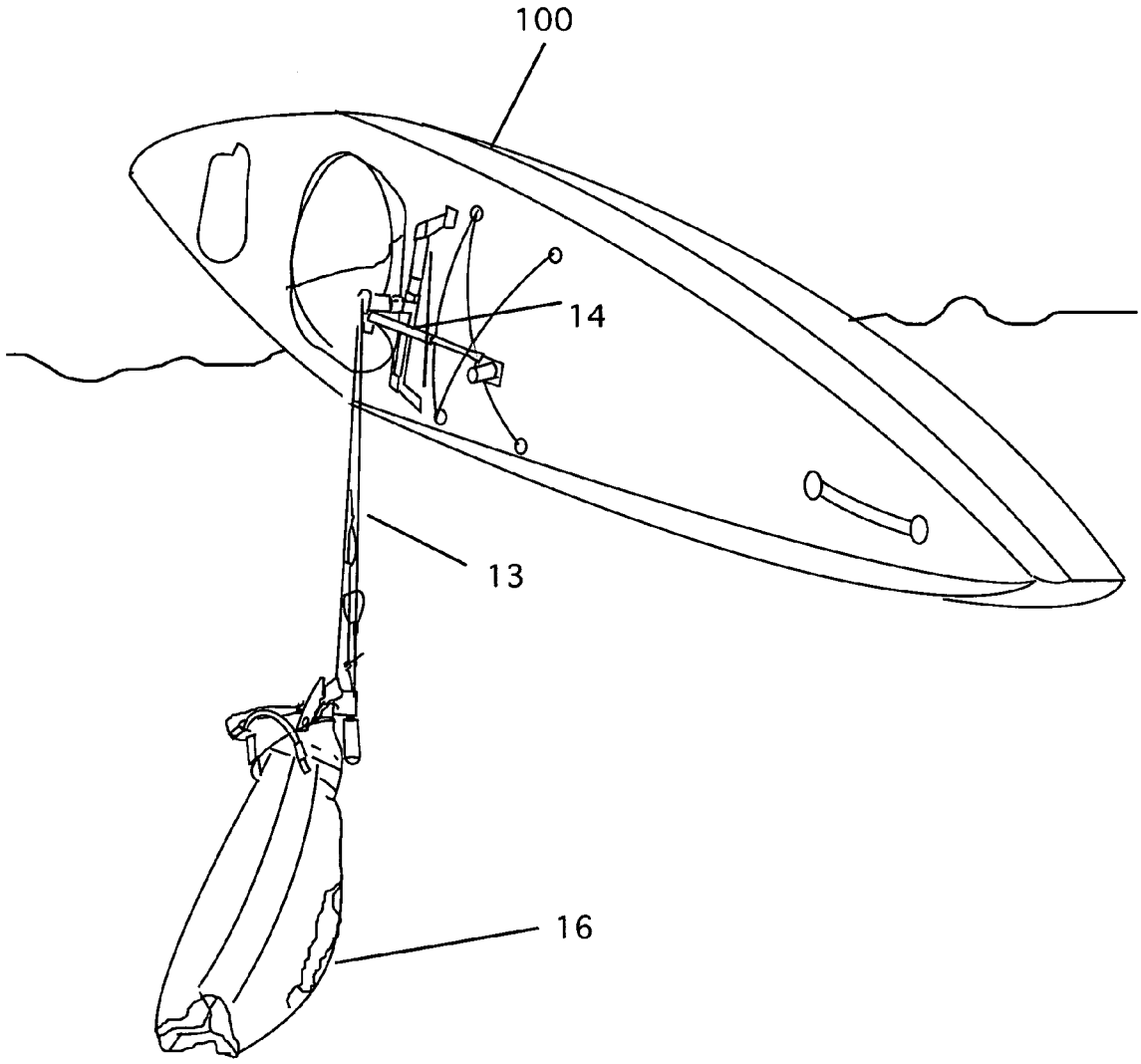
FIG. 5 is a front perspective view of the kayak showing the mast turned down with the option worm gear drive.
Figure 6:
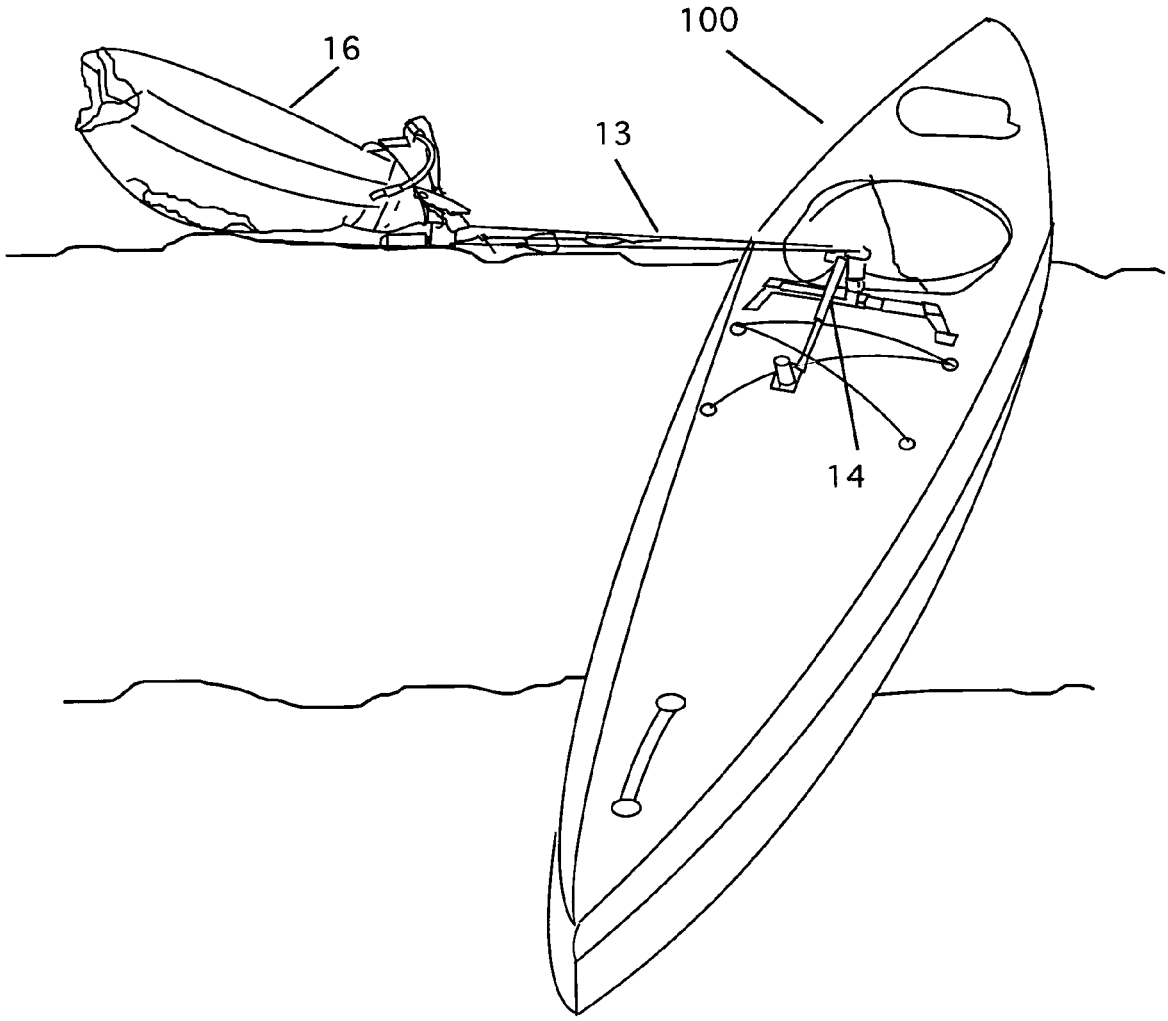
FIG. 6 is a front perspective view of the kayak showing the mast turned down with the option worm gear drive, the kayak turned upright and the mast and bag acting as an outrigger.

FIG. 4 is a side perspective view of the kayak showing the mast turned down with the option worm gear drive. In this figure, the user can use an optional worm drive 40 (see FIG. 11) to turn the mast and bag down into the water. FIG. 5 shows the mast fully deployed in the down position. As the mast is cranked down into the water, the bag acts to turn the kayak upright. FIG. 6 shows the kayak 100 turned upright with the mast 18 and bag 16 acting as an outrigger. Here, the kayak 100 is fully rotated upright with the system still deployed. The bag is still inflated and the mast is locked in the horizontal position. At this point, the kayak has been righted. In this way, the user can self-right the kayak and then use the mast and bag to maintain stability.

Of course, after an incident in which the kayak is capsized, the user will be wet and possibly injured. Normally, the user, and any companions will proceed to land to recover, and rest before proceeding with the kayaking trip. Eventually, when the operator is on land, the mast can be rotated back to parallel with the kayak and the operator can then release the mast 13 to lay it back down. However, the user may prefer to keep the mast in the outrigger position until the user is safely back at the final destination.

Figure 7:
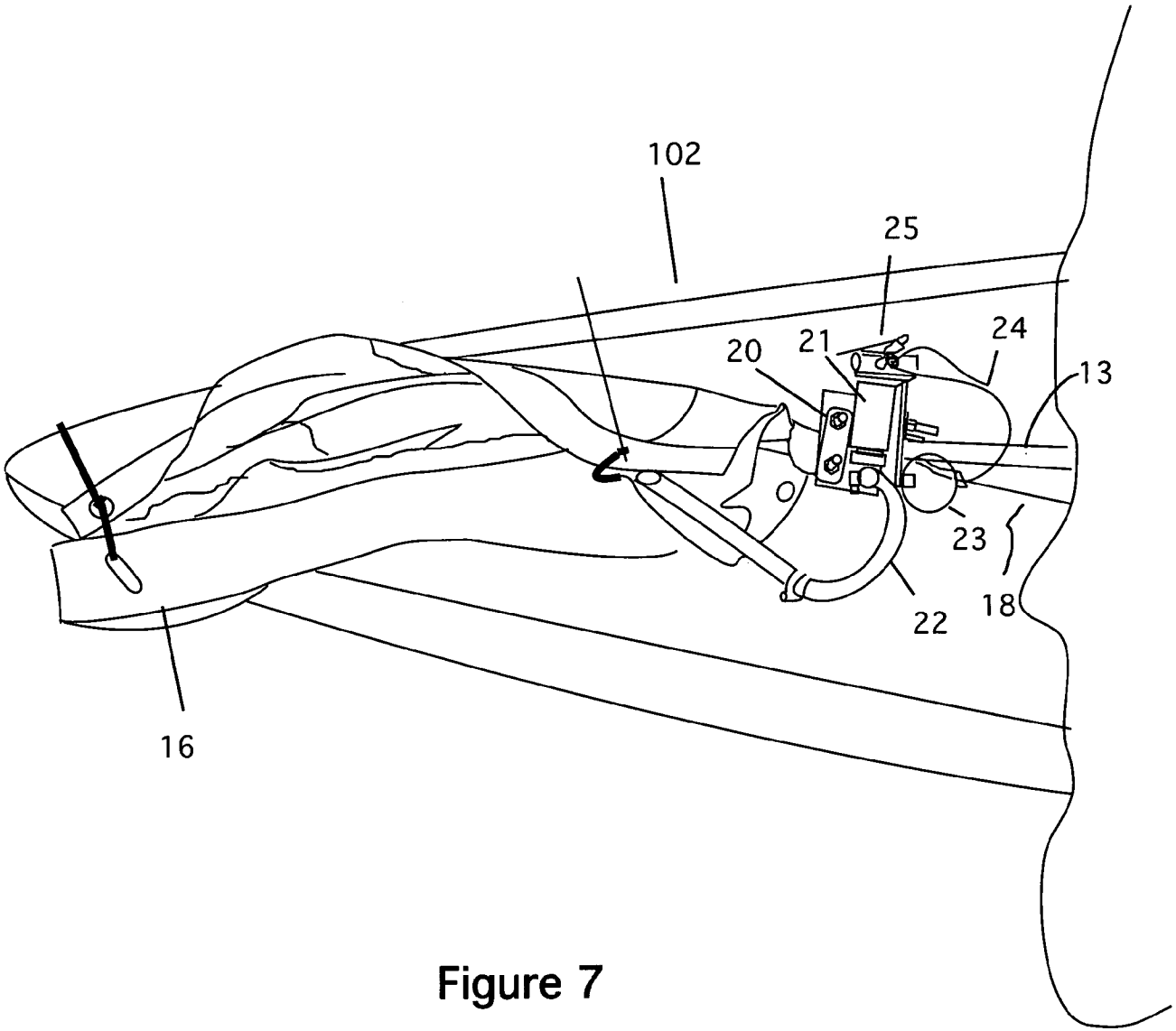
FIG. 7 is a detail view of the bag and inflation system, in the non-deployed configuration.

FIG. 7 is a detail view of the bag and inflation system, in the non-deployed configuration. This view shows the bow 101 of the kayak. The mast 13 extends forward as shown. At the top of the mast 13 is a mounting plate 20 that holds a canister 21 for inflating the bag 16. A tube 22 attached to the canister that is used to inflate the bag. The lanyard 18 is attached to a ring 23 that has a line 24 that is attached to a valve 25. The ring also has a pin 30 (see FIG. 7) attached. The pin holds the mast down on the deck. Thus, when the lanyard 18 is pulled, it releases the ring 23, which releases the mast and, in turn, pulls the line 24, which in turn, opens the valve to inflate the bag 16.

Figure 8:
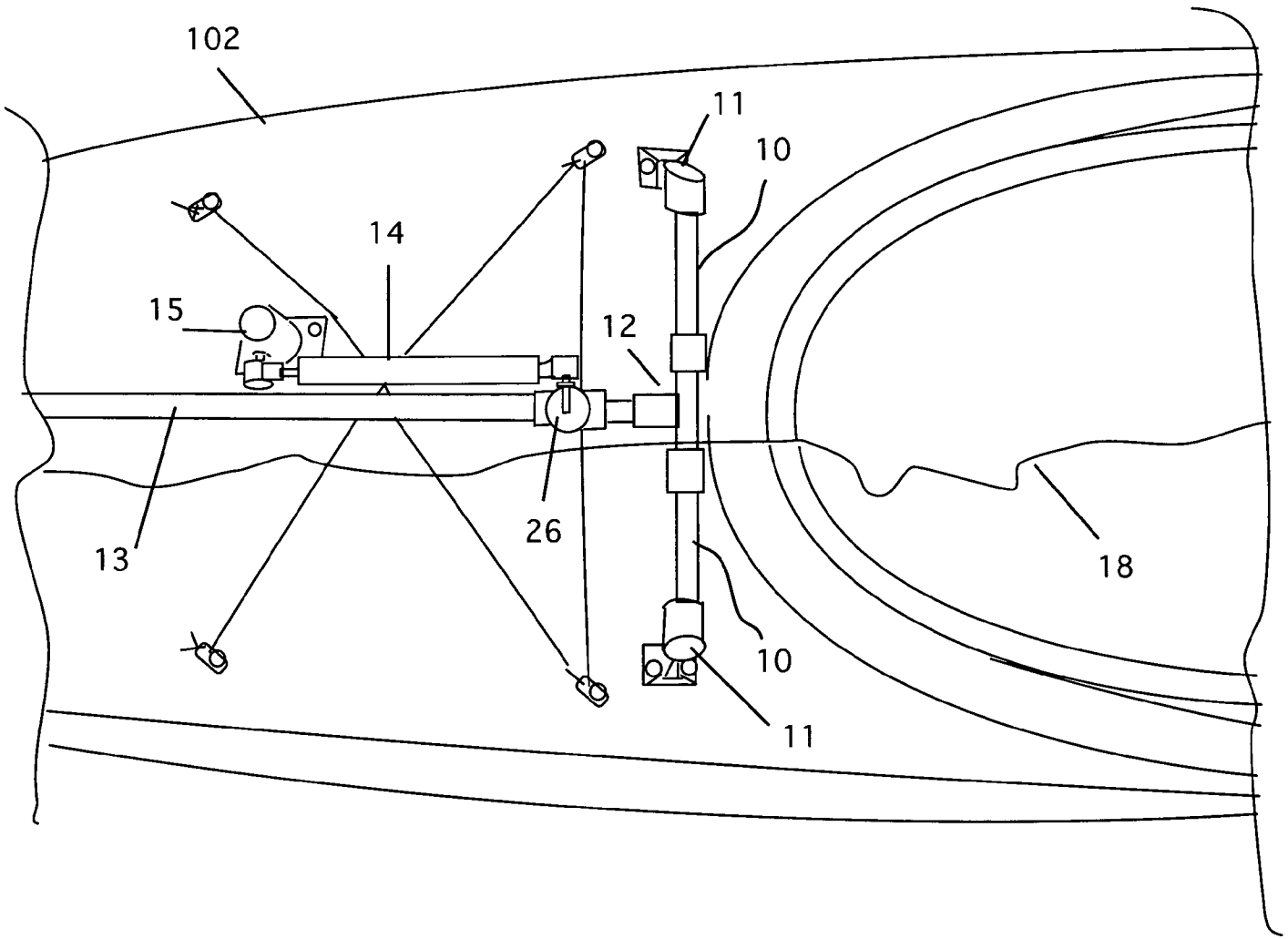
FIG. 8 is a detail view of the hinged base of the mast without the optional worm gear system.

FIG. 8 is a detail view of the hinged base of the mast. It shows that the mast 13 extends aft to a point near the entrance of the kayak. The end of the mast fits into the connector 12, which is attached to the hinge arm 10. The hinge arm is held by two brackets 11, which are secured to the deck 102. The brackets allow the hinge arm to rotate freely. A gas lift arm 14 is attached to the mast at fitting 26, and to a bracket 15, which is attached to the deck 102 as shown. The gas lift arm 14 is used to aid in lifting the mast 13 and holding it in an upright position. Note that this figure also shows the lanyard 18 as it extends back into the entrance hole.

Figure 9:
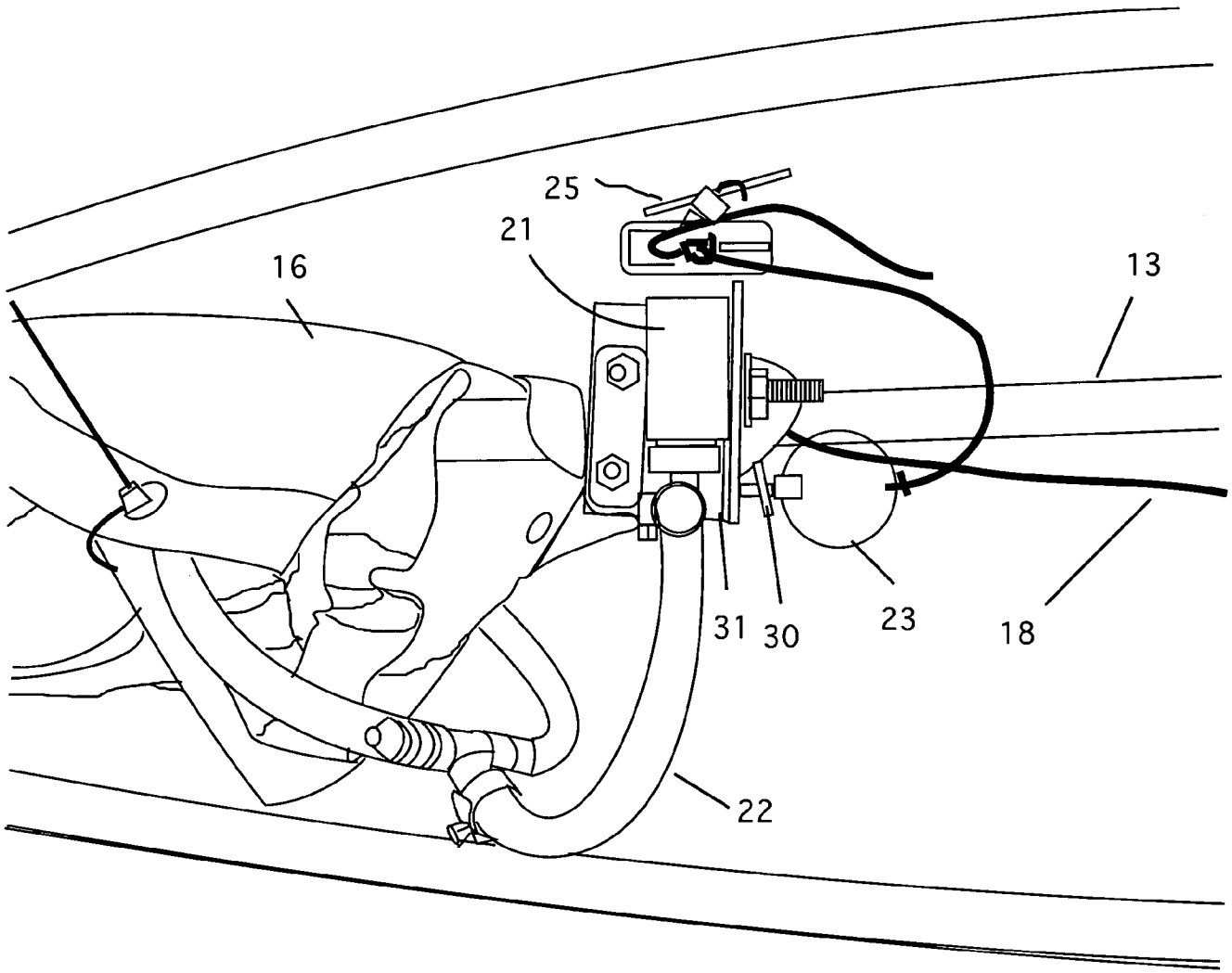
FIG. 9 is a top detail of the inflation system for the device.

FIG. 9 is a top detail of the inflation system for the device. This is an enlarged view of the inflation system. As discussed above, the lanyard 18 is shown attached to the ring 23. Note that the pin 30 passes through the bracket 31, which holds the mast down on the deck. When the pin 30 is pulled, the head of the mast is free to lift up into the position shown in FIG. 2. This figure also shows the line 24, which attaches to the inflation valve 25 that connects to the canister 21. Note that this figure shows the tube 22 extending from the canister. The tube is shown splitting into two tubes that inflate the bag 16. Of course, other tubing and inflation means can be used as is well known in the art.

Figure 10:
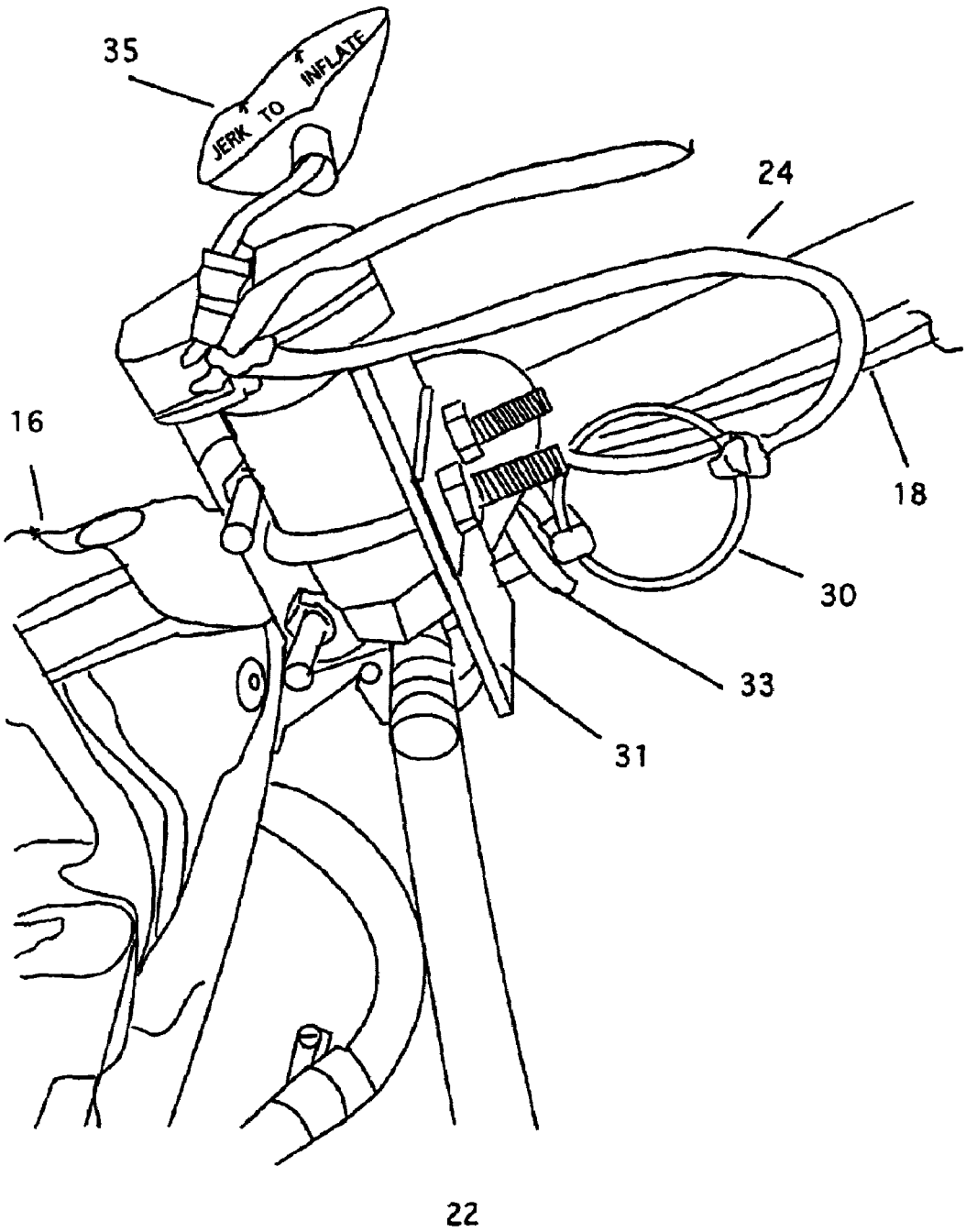
FIG. 10 is a side perspective detail of the inflation system for the device.

FIG. 10 is a side perspective detail of the inflation system for the device. Here additional details of the inflation system are shown. Note that the pin 30 passes through a bracket 33. This bracket secures the mast. This figure also shows an auxiliary inflation handle 35 that is attached to the valve. This handle is provided with the canister system.

Figure 11:
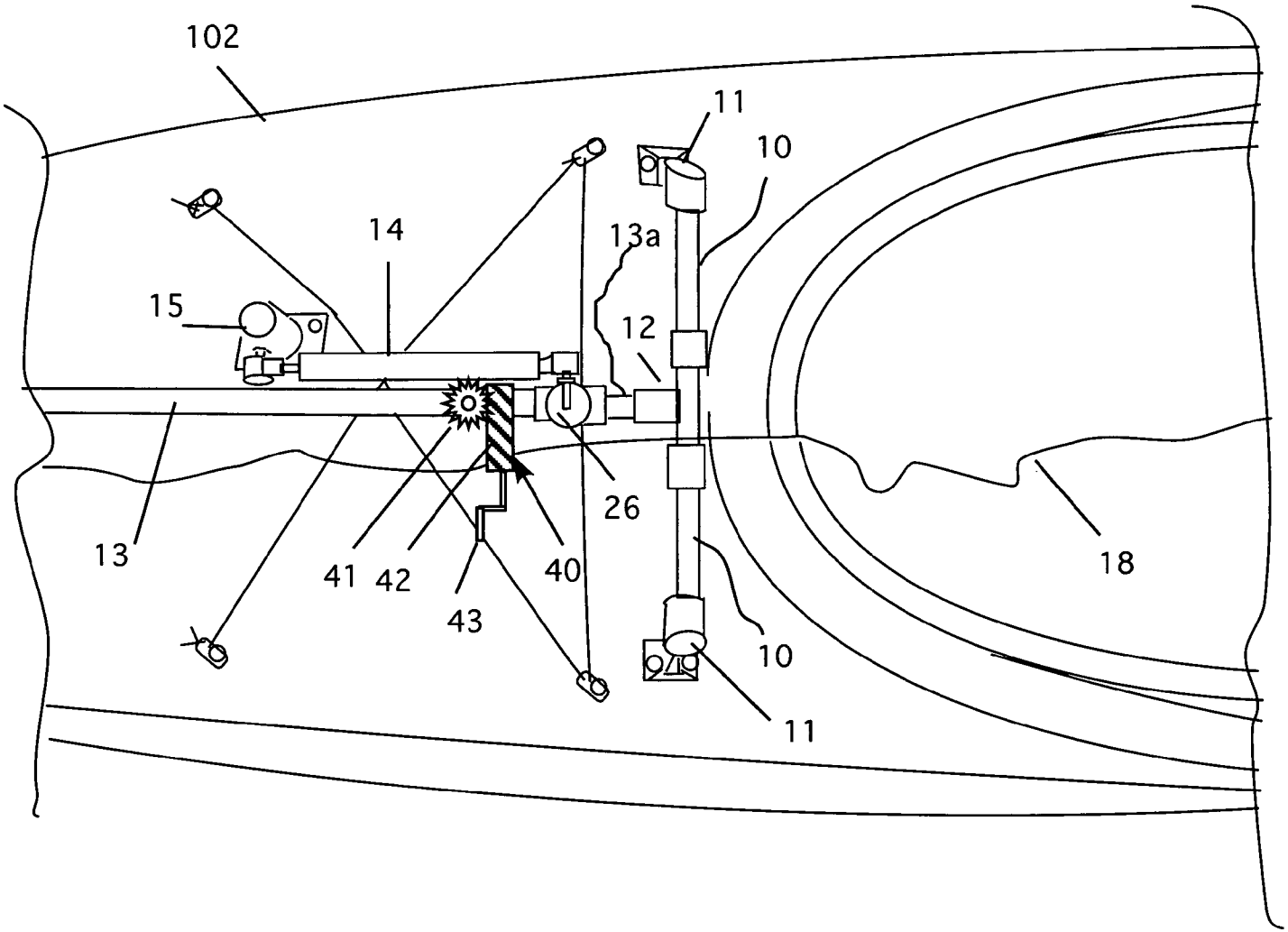
FIG. 11 is a detail view of the hinged base of the mast with the optional worm gear system.

FIG. 11 is a detail view of the hinged base of the mast with the optional worm gear system. FIG. 11 shows that the mast 13 extends aft to a point near the entrance of the kayak, as before. The end of the mast, however, terminates above the connector 12. At the base of the mast 13 is a gear 41 that engages with a worm gear 42 that is turned by a crank 43. These components make up the optional worm ear assembly 40. A mast extension 13*a* extends down from the worm gear 42 where it connects to the connector 12, which is attached to the hinge arm 10. As before, the hinge arm is held by two brackets 11, which are secured to the deck 102. The brackets allow the hinge arm to rotate freely. A gas lift arm 14 is attached to the mast at fitting 26, which is now attached to the mast extension 13*a*, and to a bracket 15, which is attached to the deck 102 as shown. The gas lift arm 14 is used to aid in lifting the mast 13 and holding it in an upright position. Note that when the mast is upright, the gas lift arm 14 does not interfere with the action of the worm gear system 40.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. A device for righting a kayak having a top foredeck comprising:

a) a mast having a distal end and a proximate end, whereby the proximate end is hingably attached to the top foredeck of said kayak, said mast being maintained in a stored position lying flat on said fore deck when said device for righting a kayak is not in use;

b) an inflatable bag, attached to the distal end of said mast;

c) a means for inflating said bag, attached to said bag; and d) a means for rotating said mast to a position perpendicular to said top foredeck of said kayak simultaneously as said inflatable bag is being inflated.

2. The device of claim 1 further comprising a means for locking said mast in a position perpendicular to said top foredeck of said kayak.

3. The device of claim 1 further comprising a means for actuating the means for inflating the bag.

4. The device of claim 1 wherein the means for inflating said bag includes:

a) a gas cartridge; and b) a tube, attached to said gas cartridge and to said inflatable bag.

5. The device of claim 1 wherein the means for rotating said mast includes a gas lift arm, attached to said mast and to said foredeck.

6. The device of claim 3 wherein the means for activating the means for inflating comprises a lanyard, attached to the means for inflating.

7. The device of claim 1 further comprising a means for holding said mast down on said foredeck.

8. The device of claim 7 further comprising a means for releasing the means for holding said mast down on said foredeck.

9. The device of claim 8 wherein the means for releasing comprise:

a) a bracket to holds said mast, secured to said foredeck;

b) a pin installed in said bracket to prevent the upward movement of said mats; and c) a lanyard attached to said pin, such that when said lanyard is pulled, the pin is released from the bracket.

10. A device for righting a kayak having a top foredeck comprising:

a) a mast having a distal end and a proximate end, whereby the proximate end is hingably attached to the top foredeck of said kayak, said mast being maintained in a stored position lying flat on said fore deck when said device for righting a kayak is not in use;

b) an inflatable bag, attached to the distal end of said mast;

c) a means for inflating said bag, attached to said bag;

d) a means for rotating said mast to a position perpendicular to said top foredeck of said kayak simultaneously as said inflatable bag is being inflated; and e) a means for further rotating said mast to a second position, perpendicular to said position perpendicular to said top foredeck of said kayak.

11. The device for righting a kayak having a top foredeck of claim 10 wherein said means for further rotating said mast comprises:

a) a worm gear, operably attached to said kayak;

b) a mesh gear, in operable communication with said worm gear, said mesh gear being attached to said mast; and c) a crank, attached to said worm gear.

12. The device of claim 10 further comprising a means for locking said mast in a position perpendicular to said top foredeck of said kayak.

13. The device of claim 10 wherein the means for inflating said bag includes:

a) a gas cartridge; and b) a tube, attached to said gas cartridge and to said inflatable bag.

14. The device of claim 10 wherein the means for rotating said mast includes a gas lift arm, attached to said mast and to said foredeck.

15. The device of claim 10 wherein the means for inflating said bag includes a lanyard, attached to the means for inflating.

16. The device of claim 10 further comprising a means for holding said mast down on said foredeck.

17. The device of claim 16 further comprising a means for releasing the means for holding said mast down on said foredeck.

18. The device of claim 17 wherein the means for releasing comprise:

a) a bracket to holds said mast, secured to said foredeck;

b) a pin installed in said bracket to prevent the upward movement of said mats; and c) a lanyard attached to said pin, such that when said lanyard is pulled, the pin is released from the bracket.

* * * * *